US007334584B2

(12) United States Patent
Mathiez

(10) Patent No.: US 7,334,584 B2
(45) Date of Patent: Feb. 26, 2008

(54) PROFILED SYSTEM FOR APPLYING A COSMETIC PRODUCT, METHOD FOR MAKING SAME, AND APPLICATOR ASSEMBLY AND ASSEMBLING METHOD FOR SUCH AN ASSEMBLY

(75) Inventor: Jean-Louis Mathiez, Limours (FR)

(73) Assignee: Coty S.A.S., New York, NY (US)

( * ) Notice: Subject to any disclaimer, the term of this patent is extended or adjusted under 35 U.S.C. 154(b) by 358 days.

(21) Appl. No.: 10/477,316

(22) PCT Filed: Oct. 18, 2002

(86) PCT No.: PCT/FR02/03573

§ 371 (c)(1),
(2), (4) Date: Aug. 4, 2004

(87) PCT Pub. No.: WO03/032769

PCT Pub. Date: Apr. 24, 2003

(65) Prior Publication Data

US 2004/0244808 A1 Dec. 9, 2004

(30) Foreign Application Priority Data

Oct. 19, 2001 (FR) ..... 01 13491

(51) Int. Cl.
*A45D 40/26* (2006.01)

(52) U.S. Cl. ..... 132/218; 401/122

(58) Field of Classification Search ..... 132/218, 132/313, 317; 401/121, 122, 126, 128, 129, 401/130; 249/141; 425/812, 401
See application file for complete search history.

(56) References Cited

U.S. PATENT DOCUMENTS 3,195,545 A 7/1965 Lederberg et al. ..... 132/79

(Continued)

FOREIGN PATENT DOCUMENTS

FR 2796527 1/2001

(Continued)

*Primary Examiner*—Todd E. Manahan
(74) *Attorney, Agent, or Firm*—Schwegman, Lundberg & Woessner, P.A.; Janal M. Kalis

(57) ABSTRACT

In order to enable application of a calibrated dose of product deposited on the brush, the invention proposes an application system whereof the stem, the brush and the stripper have a similar type of profiled shape. A profiled system for applying a cosmetic product comprises an applicator mounted on a stem, and a stripper (32) having an opening (34) through which the applicator passes. The stem is integral with a capsule (12) and the stripper mounted on the neck of a small bottle containing the cosmetic product. The invention is characterized in that the applicator consists of a comb (10) and the stem (14) forms an extension of the comb (10). The stem, the brush and the opening of the stripper have a substantially identical cross-section, whereof the contour includes a protuberance with substantially elongated section in a median plane (P).

22 Claims, 8 Drawing Sheets

U.S. PATENT DOCUMENTS

Figure 1:
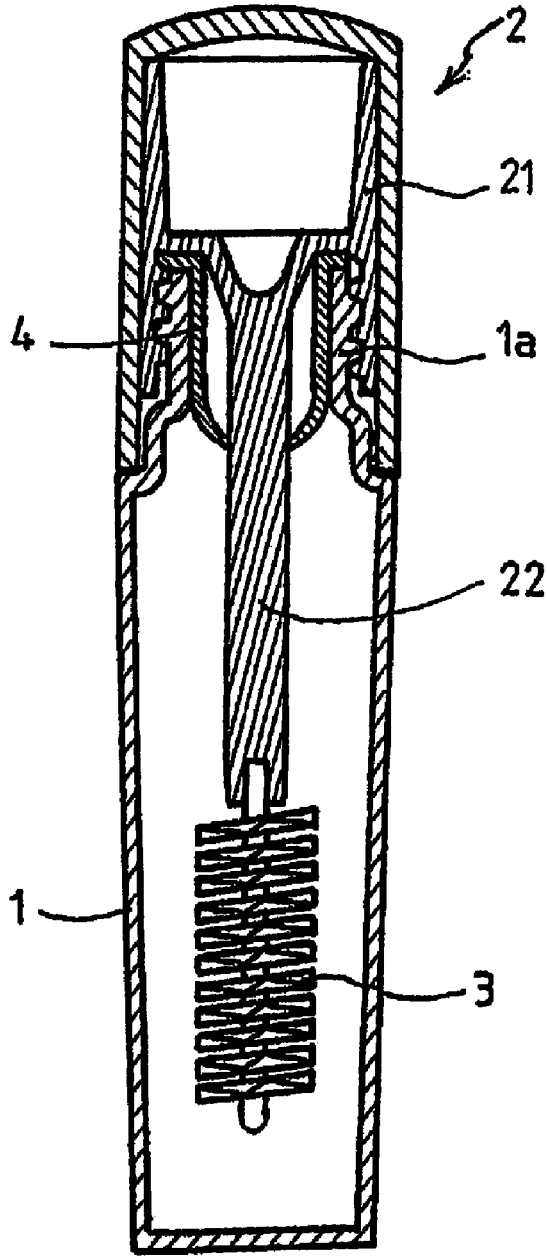
FIG.1 PRIOR ART

| | | | | |
|---|---|---|---|---|
| 3,363,635 | A | 1/1968 | Wurmbock | 132/88.7 |
| 3,384,547 | A | 5/1968 | Palmerio et al. | 167/85 |
| 3,892,248 | A | 7/1975 | Kingsford | 132/88.7 |
| 3,896,823 | A * | 7/1975 | Spatz | 132/218 |
| 3,930,280 | A * | 1/1976 | Vasas | 15/257.05 |
| 4,804,004 | A | 2/1989 | Taylor | 132/218 |
| 4,810,122 | A * | 3/1989 | Cole | 401/122 |
| 5,086,793 | A * | 2/1992 | Kingsford | 132/218 |
| 5,137,387 | A | 8/1992 | Byrd | 401/122 |
| 5,775,827 | A * | 7/1998 | Packham et al. | 401/129 |
| 6,616,366 | B1 * | 9/2003 | Weihrauch | 401/286 |

FOREIGN PATENT DOCUMENTS

| | | |
|---|---|---|
| GB | 1376119 | 12/1974 |

* cited by examiner

PROFILED SYSTEM FOR APPLYING A COSMETIC PRODUCT, METHOD FOR MAKING SAME, AND APPLICATOR ASSEMBLY AND ASSEMBLING METHOD FOR SUCH AN ASSEMBLY

CROSS-REFERENCE TO RELATED APPLICATIONS

This application claims the benefit of priority under 35 U.S.C. §§ 365(c) and 120 to International Application Number PCT/FR02/03573 filed Oct. 18, 2002 and published in English as WO 03/032769 A1, which application and publication are incorporated herein by reference. The present application, a nationalization of PCT/FR02/03573 claims priority benefits under 35 U.S.C. § 119 to French Application No. 01/13491, filed Oct. 19, 2001, which applications and publication are incorporated herein by reference.

The invention relates to a profiled system for applying liquid or cream cosmetic products, such as mascara for eyelashes or eyebrows, a method for fabricating such a profiled system, as well as an applicator assembly featuring such a system and a method for assembling this type of assembly.

Applicator systems for eyelashes and eyebrows generally consist of an applicator in the form of a brush, a brush-holding shaft to hold and measure the pre-set quantity of product, and a wiper seal, which limits the amount of product picked up by the brush and wipes off the shaft.

In order to allow extraction of a product adapted to the application, various solutions were proposed.

It is known, for example, from U.S. Pat. No. 5,137,387, how to effect the rotation of the application system with respect to the cap or the wiper with respect to the flask, which allows adaptation to any brush profile.

Some application systems substitute a rigid tip made of injected plastic in place of the brush.

Patent FR 2 796 527, for example, describes a brush featuring rows of teeth made of plastic material that are alternately slanted, forming notches. According to U.S. Pat. No. 4,804,004, the molded applicator comprises a brush made of cylindrical plastic bristles projecting perpendicularly from a base.

State-of-the-art applicator techniques do not enable application of a measured amount of the product deposited on the brush, making it difficult to apply a sufficient quantity of cosmetic product.

The invention is intended to remedy the disadvantages of the above-mentioned state of the art by proposing an application system whose stem, brush, and wiper all have similar profiles.

More precisely, the object of the invention is a profiled application system for cosmetic products for eyelashes or eyebrows comprising an applicator mounted on an elongated shaft along an axis, as well as a wiper with an opening through which the applicator passes.

The shaft is integral with a capsule, and the wiper is integral with the groove of a flask containing the cosmetic product. With this system, the shaft has at least one continuous projection along its longitudinal axis, and the applicator is a comb whose cross-sectional contour is essentially the same as that of the shaft, and the opening in the wiper has a contour that is essentially fitted to the cross-section of the shaft.

Under these conditions, a calibrated dosage is achieved when a specified volume of product is deposited into the brush row through the opening of the wiper with the same profile.

According to the specific method of production of the application system:

- the comb has at least one row of teeth, whose interstitial dimensions are determined as a function of the type of composition and texture of the product being applied, in order to measure the quantity of product likely to be restored during application
- the capsule is screwed or snapped onto the flask
- the flask has at least one comb orientation ramp on the wiper opening to permit alignment of the comb contour with this opening
- a lip around the wiper opening to scrape excess product deposited on the comb, and a guide bead is formed in the wiper to ensure centering of the comb and shaft on the lip
- at least one retaining ring on the outside surface of the wiper permits rotation of the wiper, while keeping the wiper upright in the flask
- the comb is formed by one or two extensions that are diametrically opposed to the longitudinal axis extending along a median plane and carrying one or two rows of teeth; these teeth may or may not be diametrically opposed
- the shaft, comb and opening of the wiper have a cross-section that is substantially identical to three to eight projections, forming a star-shaped cross-section
- the teeth in each row are adapted to the dedicated functions by means of different interstitial gaps between the teeth in the first row relative to the second, on the one hand, and by the flat or biconcave shape of the external sides of the respective rows, on the other in order to deposit a cosmetic product on the upper or lower eyelashes, respectively, as well as to produce a "volumizing" or separating effect
- the functions intended to separate or apply [cosmetic products] to the lower eyelashes are carried out using a comb that has flat sides fitting into a convex lip of the wiper in order to exert greater pressure on the row with flat sides above that exerted on the concave row
- the profiles of the shaft, comb and wiper opening are of quadriconcave, quadrilinear or biconcave-bilinear shape
- visual or mechanical means of foolproofing are fitted to the comb and/or the wiper in order to position so that it faces the faces of the comb and the wiper that must fit together during the insertion of the shaft into the wiper.
- the comb features, at its end, at least one beveled section to facilitate the insertion of the comb into the wiper
- the shaft and the comb and, optionally, the housing, are molded from a single molded piece
- the wiper material is chosen from either a low-density polyethylene or an elastomeric thermoplastic material
- the comb and shaft material may be made from polypropylene, polyamide or polyoxymethylene.

The invention also relates to an applicator assembly, comprising the above-mentioned application system combined with a packaging case adapted for this system, as well as an assembly method for an applicator assembly.

With this method, the first step is to pre-position the wiper on the shaft; once the flask has been filled with the product, the shaft is inserted into the groove of the flask the first time that it is closed, i.e., when the packaging case abuts against the vial; the wiper is drawn in by the housing and is permanently set into the groove of the vial.

According to an advantageous manufacturing process, when the casing abuts against the vial, by being pushed or screwed down, the wiper ends up in an intermediate position in which the ring is in contact with a portion of the groove. In this position, the groove exerts a force with an axial component on the ring then being inserted, whereas in the groove, in a permanent retaining position, some play is created between the wiper and the extent of the casing. This means of production thus makes it possible to avoid a double simultaneous gap between the casing and the wiper and between the casing and the vial.

The invention also relates to a manufacturing process for such a system, in which the shaft and comb assembly is realized by molding. This mold advantageously has one or more of the joint planes arranged outside the toothed portion of the comb. In this way, the mold leaves no burr on or between the teeth and there is no risk of the comb tearing or cutting the user's eyelashes.

The mold also advantageously has vent holes in close proximity to the teeth to allow air to escape during injection of the plastic.

In order to facilitate the unmolding of the product, the comb is molded around an axial pinto hold this comb along the longitudinal axis during unmolding.

Figure 2:
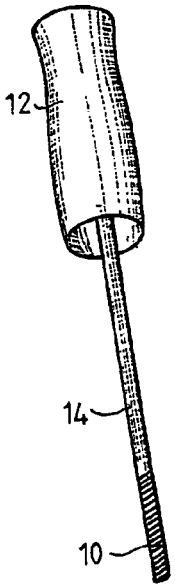
Figure 3:
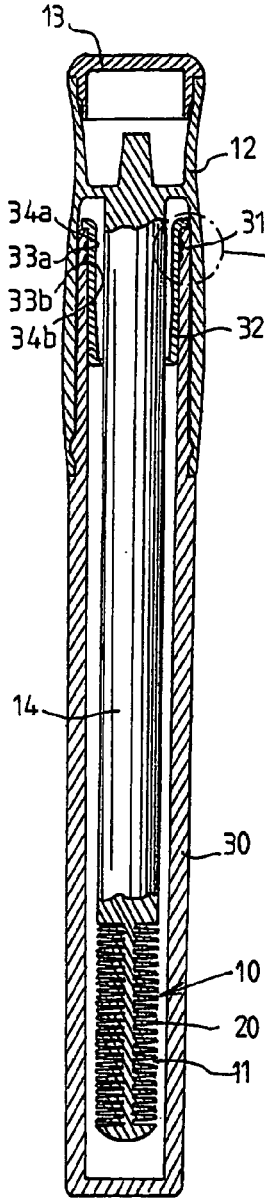
Figure 3A:
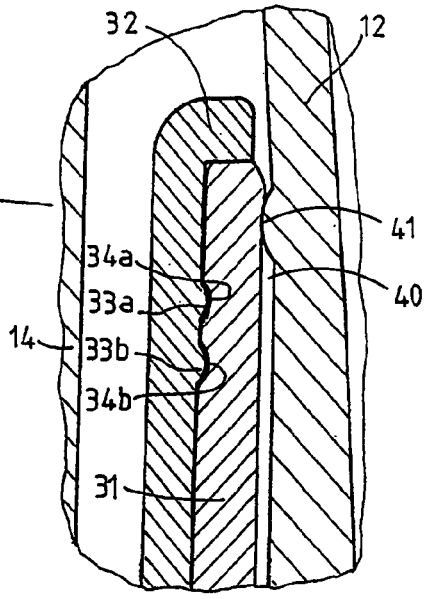
Figure 4A:
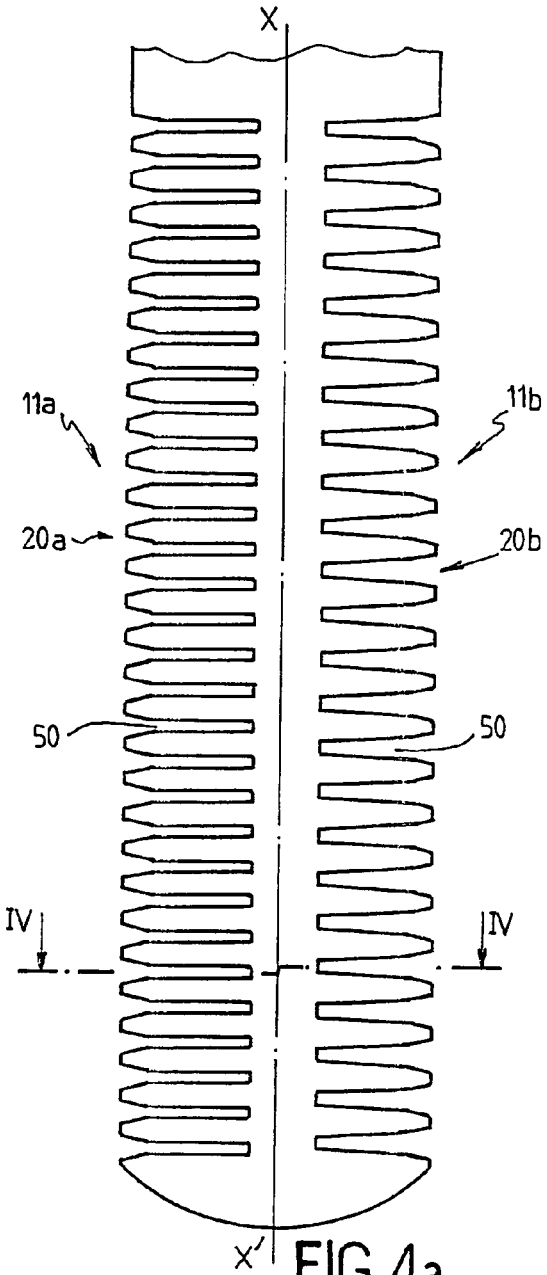
Figure 5:
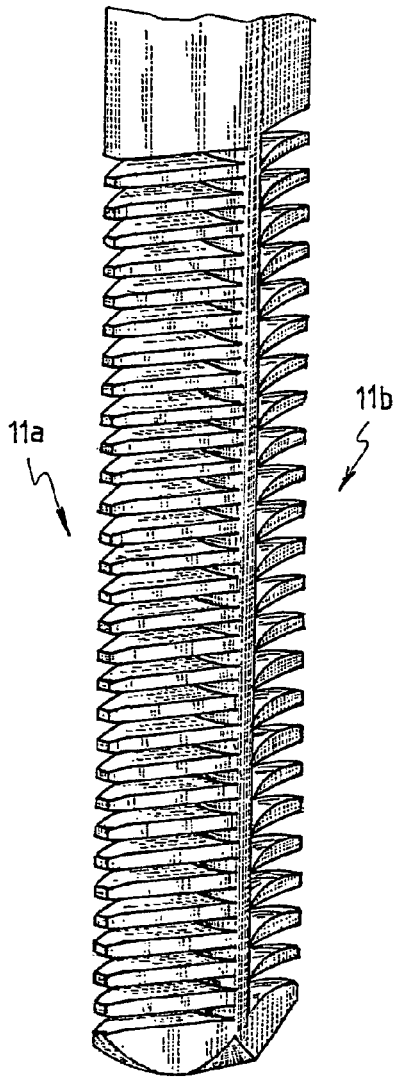
Figure 4B:
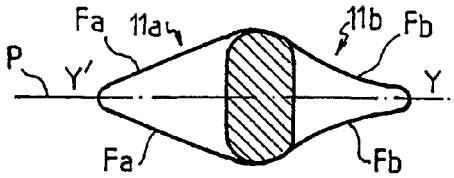

Other characteristics and advantages of the invention will become apparent upon reading the following description pertaining to an embodiment referred to in the attached figures, which represent the following, respectively:

FIG. 1, a longitudinal cross-section of an applicator assembly according to the prior art FIG. 2, an isometric view of an example of a comb and shaft mounted on a housing for an application system according to the invention FIGS. 3 and 3*a*, a longitudinal cross-sectional view of an applicator assembly according to the invention, and a blow-up of part of this view FIGS. 4*a* and 4*b*, longitudinal and cross-sectional views IV-IV of a comb with two rows of teeth in an application system according to the invention FIG. 5, an isometric view of the comb according to FIGS. 4*a* and 4*b*

Figure 6:
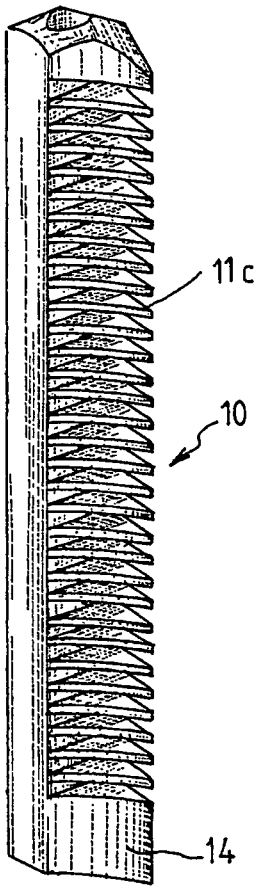

FIG. 6, an isometric view of a comb with a single row of teeth

Figure 11:
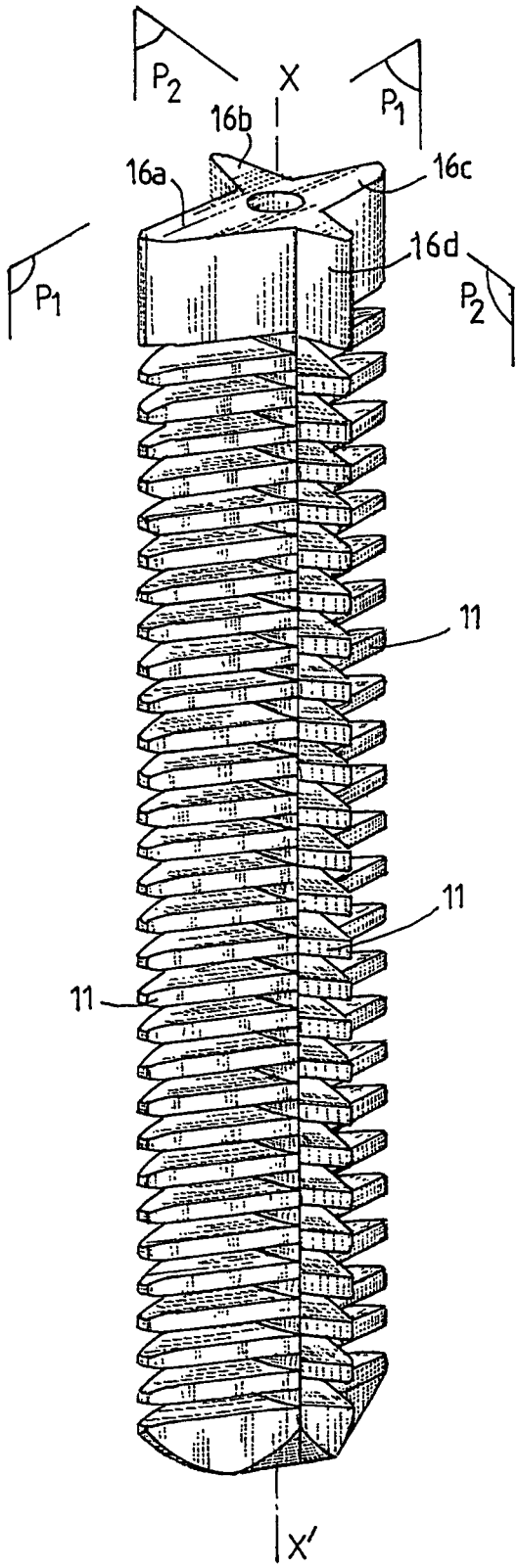
Figure 7A:
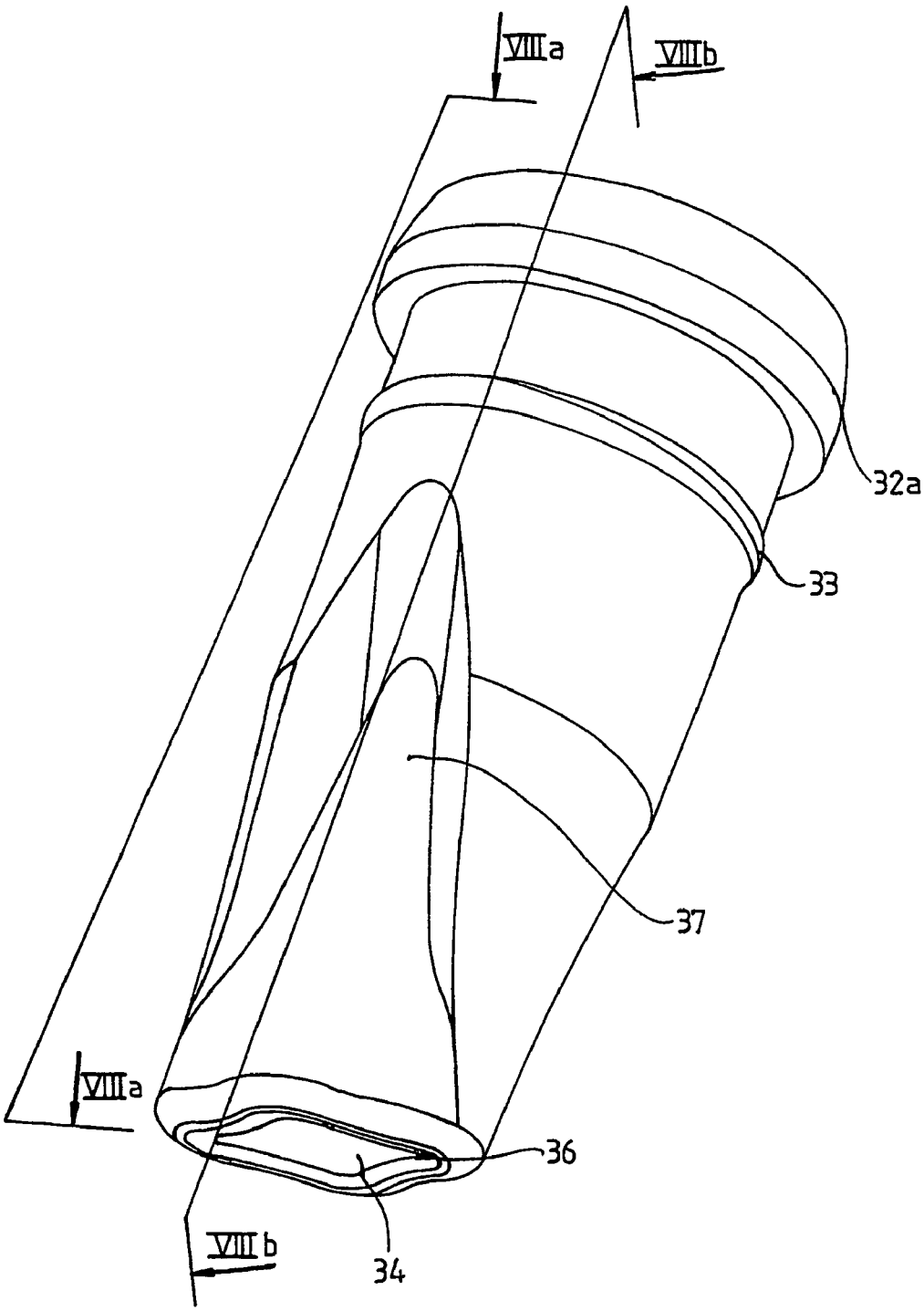
Figure 7B:
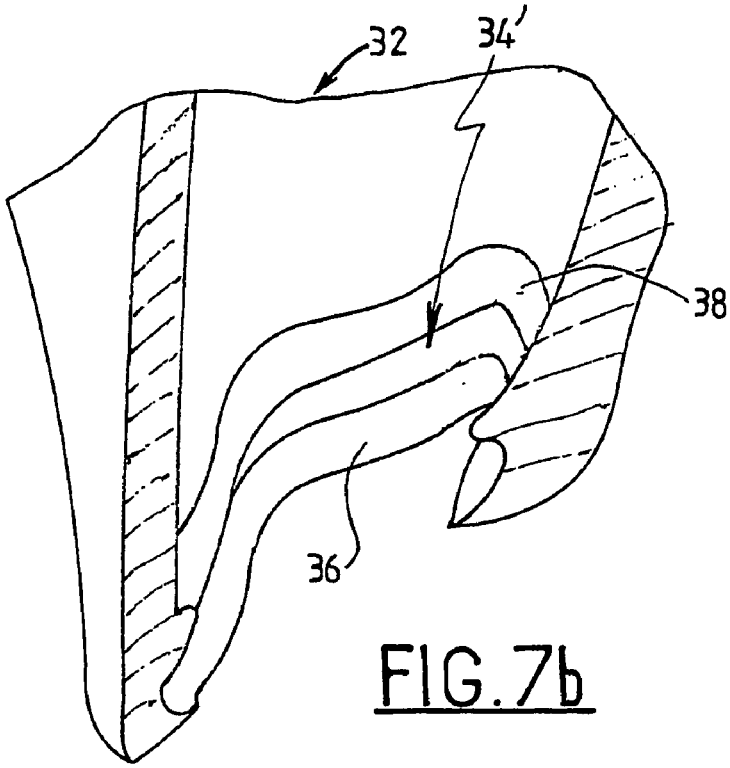
Figure 8A:
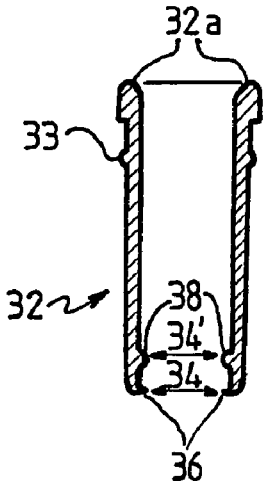
Figure 8B:
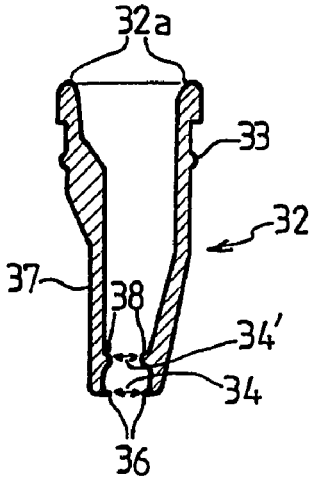
Figure 9:
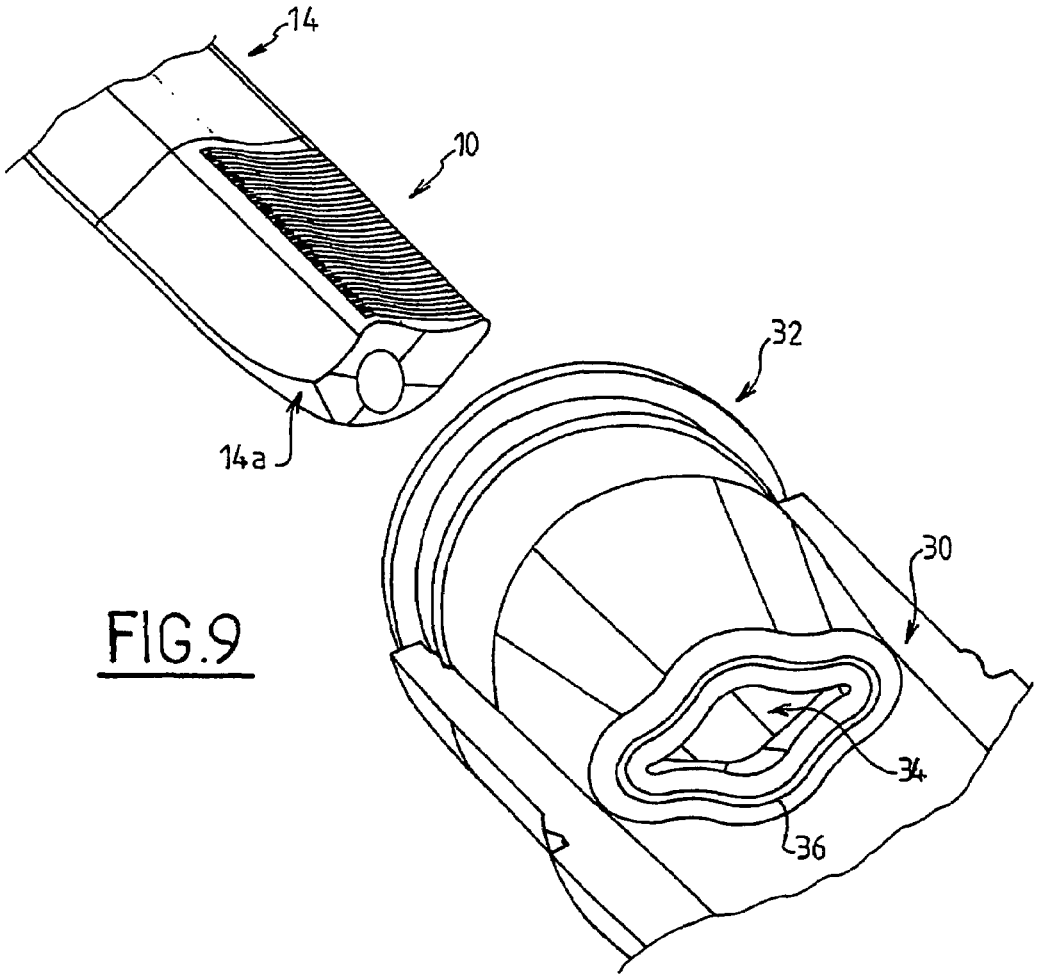
Figures 10A, 10B, 10C, 10D:
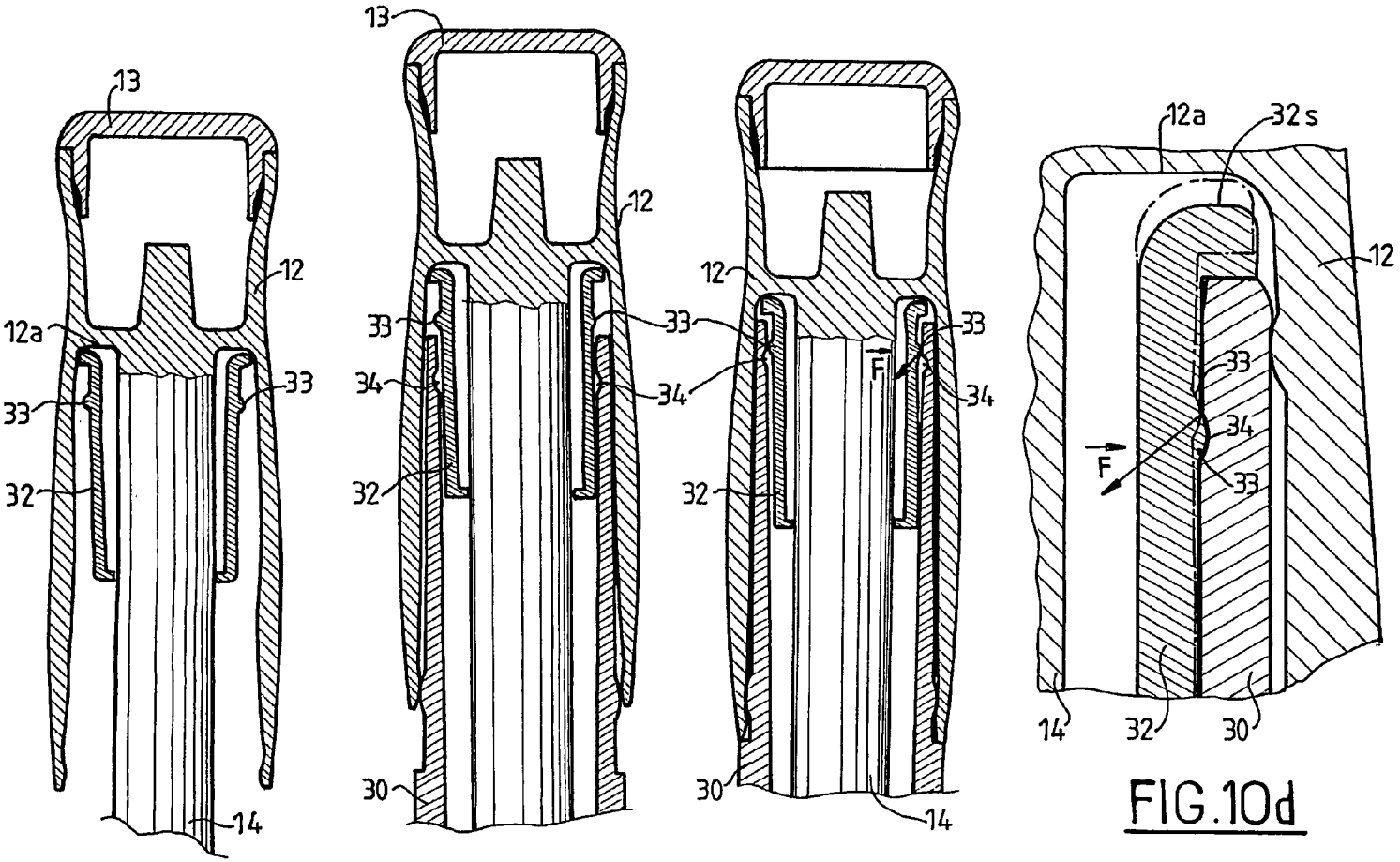

FIGS. 7*a* and 7*b*, an isometric view and a partial cutaway view of a wiper in an application according to the invention FIGS. 8*a* and 8*b*, longitudinal sectional views of the wiper in two perpendicular cutting planes;

FIG. 9, a perspective view and partial cutaway view of the applicator system FIGS. 10*a* to 10*d*, partial cutaway views of the main stages of a method for assembling an applicator assembly according to the invention which, in its final stage (FIG. 10*d*), has been enlarged; and FIG. 11, a perspective view of a comb with four rows of teeth and a cross-shaped profile.

In the figures, identical reference numbers refer to identical or corresponding elements. As illustrated in FIG. 1, a mascara applicator assembly according to the prior art comprises the following:

- a receptacle (1), containing the mascara reservoir, called a "vial" and generally manufactured by means of injection or extrusion blow molding of plastic material
- a device (2) for plugging the vial, called a shaft-casing comprising, when assembled, a casing (21), a threaded-head shaft (22) and a brush (3); the shaft screws down onto casing (2) (sic) on vial (1) carrying brush (3) affixed to it, and
- a wiper joint (4), intermediate element between the vial and the shaft casing, mounted in the insertion groove (1*a*) of vial (1), and which has a dual function of ensuring watertightness between the vial and the casing in the closed position (as shown), and removing excess cream from the brush, as well as wiping off the shaft during use.

In comparison, the perspective view of FIG. 2 illustrates an example a shaft-casing system for mascara application according to the invention, comprising a comb (10) mounted on a casing (12) by means of a shaft (14), with this shaft having a contour identical to that of the teeth (11) of the shaft. The comb thus appears to be formed by ablation of the material at the end of the shaft.

An example of the complete applicator assembly according to the invention, as seen from the longitudinal cross-sectional view through the axis of symmetry X'X as illustrated in FIG. 3 and the partially enlarged view. FIG. 3*a*, thus consists of the following:

- shaft (12), topped with a tip (13) which is countersunk into it:
- shaft (14) with a comb (10) at its end, forming a single piece with casing (12) in this embodiment
- a wiper (32), and
- a vial (30) whose insertion groove (31) acts as a seat to the wiper.

The securing of casing (12) onto vial (30) is ensured by snapping (FIG. 3*a*) between a contact surface (40) on the casing connected with an annular boss (41) belonging to the casing and the groove of the vial. In order to keep the wiper in the groove, two annular rings, (33*a*) and (33*b*), formed on the circumference of wiper (32), slide into annular grooves (35*a*) and (35*b*) formed in vial (30). Such a connection allows the wiper, on the one hand, to remain in place when the comb is withdrawn from the vial and wiped, and, on the other, to rotate around axis X'X so that it aligns with the comb when comb is reinserted into the vial.

FIGS. 4*a* and 4*b* show more clearly comb (10) and a portion of shaft (14), viewed as a longitudinal section according to a median plane P and in cross-section according to IV-IV.

Comb (10), whose width and length are 7 mm and 25 mm respectively, has two regular rows, (11*a*) and (11*b*), formed by evenly spaced teeth (11). The teeth in each row extend in opposite directions starting from the axis of symmetry X'X. Row (11*a*) has longer teeth, 2.9 mm compared to 2.6 mm, separated by an average space smaller than the teeth in the opposite row 11*b*, 0.2 mm, compared to 0.4 mm.

As shown in the cross-section in FIG. 4*b*, the comb and shaft mainly extend along an axis, Y'Y forming the path of the plane of median section P of FIG. 4*a*, with a geometric shape that is generally diamond-shaped, flattened along the main diagonal Y'Y. Row (11*a*) has two flat sides, $F_a$, whereas row (11*b*) has two concave sides $F_b$. Rows (11*a*) and (11*b*) and the corresponding shaft parts are connected by the central core (15). The corresponding parts of the shaft follow the same profile, since the geometric envelope of the comb has a shape identical to that of the shaft.

Under these conditions, row (11*a*) contains a quantity of mascara (50) that is noticeably less than row (11*b*) between their respective teeth. The quantities of mascara are calibrated by the surfaces and by interstice 20 between the teeth. Row (11) is thus devoted solely to separating eyelashes or applying mascara (50) on the user's lower eyelashes, whereas row (11*b*) is devoted to giving volume ("volumizing effect") or to applying mascara (50) onto the user's upper eyelashes.

The shaft and comb assembly is produced by molding. The mold has a land that is perpendicular to the primary plane of the comb, which is defined by the main diagonals Y'Y of the cross-sections of the comb. As a result, the mold leaves no burrs. The mold advantageously has air holes in close proximity to the ends of the teeth, so that the mold is properly filled with the material to be polymerized, e.g., polypropylene. In order to facilitate unmolding of the two parts of the mold, and in particular the rows of teeth, a pin is inserted into the central core (15) of the comb.

The isometric view of the comb in FIG. 5 shows the differences in shape and structure of rows (11*a*) and (11*b*) of the comb according to FIGS. 4*a* and 4*b*.

According to a variation illustrated in FIG. 6, in an isometric view, a single row 11*c* is formed, with the row of the comb and corresponding shaft forming a projection along the comb's longitudinal axis X'X. The person skilled in the art adapts the length and spacing (20) of the teeth (11) of all variants to the type of product to be applied. In particular, this adaptation is a function of the chemical composition, physical properties, such as viscosity and wettability, texture and composition of the mascara (50) to be applied.

In order to permit effective scraping of the external rectilinear sides of a single- or double-rowed comb, as well as effective wiping of the shaft of the same profile, wiper (32) has an opening (34) which has four concave sides forming a "quadriconcave" assembly, as illustrated in FIGS. 7*a* and 7*b*.

The isometric view (FIG. 7*a*) shows the principal characteristics of wiper (32): a quadriconvex lip (36) for scraping the product, with the external contour of the lip forming opening (34), a narrowing point (37) for guiding the body of the wiper, corresponding to a ramp formed in the wiper for aligning the comb with the opening (34), a wiper rotation ring (33), and the upper seating joint (32*a*) on the vial.

The partial cutaway view of the wiper (FIG. 7*b*) shows in greater detail the presence of a bead (38) for centering and wiping the comb in the wiper, which forms a passage (34'). Such a bead, formed inside the wiper, is sufficiently resistant to guide the comb and align it with opening (34). In this way, when the user turns the casing, as is normally done with a conventional closure system, the bead (38) on the wiper is able to bear the forces generated by the shaft in the wiper without being damaged, while protecting lip (36) which is as fine as a blade, and which would otherwise be deformed and damaged.

This bead is continuous in the example shown, but may be discontinuous in other variants. In the embodiment shown, but not limited thereto, the scraping lip has a thickness of about 0.5 mm with a square edge, and the centering bead has a thickness according to the longitudinal axis of about 1.7 mm with a rounded profile.

Longitudinal section views according to the perpendicular section planes VIIIa and VIIIb of the aforementioned wiper are shown in FIGS. 8*a* and 8*b*. In these figures, joint (32*a*), ring (33) and lip (36), as well as bead (38) can be seen.

In FIG. 8*a*, the body of wiper (32) appears slightly cupped and symmetrical with respect to the central axis X'X, whereas in FIG. 8*b*, it appears asymmetrical with respect to the longitudinal axis X'X, so that they fit together in the shape of opening (34) by integrating ramp (37) onto a single land of the face. Passage (34') is likewise indicated in FIGS. 8*a* and 8*b*.

FIG. 9 shows a partial cutaway perspective view of an example of an application system in use after withdrawal of comb (10) from wiper (32) with the elements of the application system aligned with an axis that coincides with the axis X'X of the comb. The opening (34) in wiper (32) is aligned with the contour of comb (10) and the envelope of the comb corresponds to the contour of opening (34) of the wiper.

At its end, the comb has a beveled portion (14*a*). This cutaway material facilitates insertion of the comb into the wiper. It may be carried out on the side without the row of teeth or on the one with the row of teeth.

In this embodiment, the wiper is produced by injection molding using a thermoplastic elastomer with a known procedure allowing unmolding of the counter-tapers formed by the bead.

An example of an assembly of the applicator assembly, featuring the profiled system of a casing and a vial, is illustrated in FIGS. 10*a* to 10*d*.

Wiper (32) is, first of all, pre-positioned (FIG. 10*a*) on shaft (14), for example, against gap (12*a*) created by casing (12) in its connection with shaft (14). After filling flask (30) with the product (FIG. 10*b*), the casing-shaft-wiper assembly is aligned axially with vial (30) and shaft (14) is introduced into groove (31) of the latter.

Thrusting casing (12) into this locking arrangement by means of a snapping motion, for example, causes it to abut against vial (30) (FIG. 10*c*), and places wiper (34), drawn in by casing (12), in an unstable intermediate position.

In this intermediate position, ring (33) is in contact with a specified portion of groove (34). Thus the groove exerts an axial component force F on ring (33) of wiper (32), shown in dotted lines on the enlarged FIG. 10*d*. The ring is thus set by itself into groove (34) according to a final retaining position of wiper (32) (indicated by solid lines) in the groove (31) of the vial, creating a play between the upper surface (32)s of wiper (32) and the gap (12*a*) in the casing. This production method thus makes it possible to avoid the creation of a double gap between the casing and the wiper on the one hand and the casing and the vial on the other.

The invention is not limited to the examples of production described and shown. For example, it is possible to provide an opening in the wiper that has a quadrilineal or biconcave—bilinear shape. In the latter case, visual or mechanical means of foolproofing are made on the comb and the wiper in order to position it in front of the rectilinear and concave sides of the comb and the wiper.

Moreover, the casing can be secured to the vial by screwing it on. In this case, the wiper is rendered so that it can rotate freely by any means known to the person skilled in the art to allow alignment of its profile with that of the comb and its shaft.

In addition, it is possible to provide rows of teeth that are not regularly spaced, in such a way as to adapt the quantity of product to be applied as a function of the area where the product is to be applied.

Moreover, the comb can have more that one or two projections, which may or may not include a row of teeth: FIG. 11 shows a comb with four projections, (16*a*) to (16*d*), with a cross-shaped cross-section, where each projection has a row of teeth 11. The row of teeth 11 spreads out two by two in opposite directions along the longitudinal axis X'X, essentially in two perpendicular median planes P1 and P2. The shaft and the wiper opening of the applicator system thus possess a cruciform profile, essentially identical to that of the comb. In these variants, the number of projections of the comb, which may be regularly or irregularly spaced along the longitudinal axis, may preferably be from three to eight, with the profile of the shaft and the opening of the wiper remaining essentially identical to that of the comb. Certain projections at beveled extremities may be provided as described above. The rows of teeth can also be staggered along the longitudinal axis by a half-step, for example, when the rows have the same separation, in order to improve the uniformity of distribution of the mascara.

The invention claimed is:

1. A profiled system for application of cosmetic product, onto eyelashes or eyebrows, the system comprising:

a flask defining a groove;

an elongated shaft having at least one continuous projection along its longitudinal axis (X'X);

an applicator mounted on the elongated shaft, wherein the applicator comprises a comb (10) having a contour whose cross-section is largely identical to that of shaft (14); and a wiper integral with the groove defined by the flask, the wiper defining an opening through which the applicator passes, wherein the wiper is sized and shaped for delivery of a calibrated dosage of cosmetic having a contour that is largely fitted to the cross-section of shaft (10) along its longitudial axis.

2. The profiled system according to claim 1, wherein comb (10) has at least one row of teeth (11) whose interstitial dimensions (20) are determined as a function of the composition and texture characteristics of the product (50) to be applied, in order to calibrate the quantity of cosmetic product that might remain during application.

3. The profiled system according to claim 1 wherein casing 12 is screwed onto flask (30).

4. The profiled system according to claim 1, wherein the wiper comprises at least one orientation ramp (37) for comb (10) an opening (34) of the wiper, to allow alignment of the comb contour (10) with opening (34).

5. The profiled system according to claim 1, further comprising a lip (36) defining the opening of wiper (32) in order to scrape excess cosmetic product deposited on the comb, and a guiding bead (38), the lip being formed inside wiper (32) to ensure centering of the comb (10) and the shaft (14) onto lip (36).

6. The profiled system according to claim 1, further comprising at least one retaining ring (33, 33*a*, 33*b*) on the external side of wiper (32) permitting rotation of wiper (32) while keeping its axial position inside vial (30).

7. The profiled system according to claim 1, in which the comb includes one or two projections that are diametrically opposed with respect to the longitudinal axis (X'X), spread out along a median plane (P) and having one (11*c*) or two rows (11*a*, 11*b*) of teeth.

8. The profiled system according to claim 7, in which the two rows (11*a*, 11*b*) of teeth are diametrically opposed with respect to longitudinal axis (X'X).

9. The profiled system according to claim 8, wherein the profiles of the shaft, comb and opening (34) of the wiper are quadriconcave, quadrilinear or biconcave-bilinear in shape.

10. The profiled system according to claim 9, in which means of visual or mechanical foolproofing are formed on the comb and/or wiper, in order to position the means so that it faces the comb and the wiper that must fit together during the insertion of the shaft into the wiper.

11. The profiled system according to claim 7, in which the teeth in each row (11*a*, 11*b*) are adapted to functions determined by the various spacings (20*a*, 20*b*) between the teeth in the first row relative to the second, on the one hand, and by the flat ($F_a$) or biconcave ($F_b$) shape of the external sides of the respective rows (11*a*, 11*b*) on the other, for applying cosmetic product (50) on upper or lower eyelashes, respectively, as well as to produce a "voluminizing" or separating effect.

12. The profiled system according to claim 11, wherein the functions intended to produce a separating effect or to apply cosmetic product on lower eyelashes are carried out by a comb (10) that has flat size which fits into a convex lip (36) of wiper (32) in order to exert pressure on the row with flat sides (11*a*) greater than that exerted on the concave row (11*b*).

13. The profiled system according to claim 1, in which the shaft, comb and opening in the wiper each have a cross-section that is substantially identical with three to eight projections, forming a star-shaped section profile.

14. The profiled system according to claim 1 in which the comb has, at one end, at least one beveled portion (14*a*) which facilitates insertion of the comb into the wiper.

15. The profiled system according to claim 1, in which the shaft and the comb are made from a single molded piece.

16. The profiled system according to claim 1, in which wiper material selected from one or more of a low-density polyethylene and an elastomeric thermoplastic material.

17. The profiled system according to claim 1 in which the comb and shaft material selected from one or more of polypropylene, polyamide and polyoxymethylene.

18. The profiled application system according to claim 1, further including a casing (12) affixed to the shaft opposite the applicator and adapted to be secured to said flask.

19. A method for assembling an applicator assembly according to claim 18, characterized in that wiper (32) is initially pre-positioned on shaft (14), and that once the flask has been filled with the product, shaft (14) is inserted into the groove (31) of the flask, and characterized in that, during the initial closure, while casing 12 abuts the flask, and wiper (32) is drawn in by casing 12 and becomes permanently set into the groove (31) of the flask.

20. A method according to claim 19, in which, when casing (12) abuts vial (30), the wiper is located in an intermediate position in which ring (33) is in contact with a portion of groove (34) such that the latter exerts an axial-component force (F) on the ring, which is then introduced into the groove in a permanently retained position, creating play between the wiper (32) and the gap (12*a*) in the casing.

21. A method for producing a profiled application system comprising: molding a shaft and comb assembly in a mold having lands(s) that are arranged outside a toothed portion (11*a*, 11*b*, 11*c*) of comb (10) wherein the lands are sized and shaped for delivery of a calibrated dosage of cosmetic and wherein a mold used for molding defines holes proximal to teeth of a toothed portion for air to escape during injection molding.

22. The method according to claim 21 wherein the comb is molded around an axial pin to hold the comb.

* * * * *

UNITED STATES PATENT AND TRADEMARK OFFICE

CERTIFICATE OF CORRECTION

PATENT NO. : 7,334,584 B2
APPLICATION NO. : 10/477316
DATED : February 26, 2008
INVENTOR(S) : Mathiez It is certified that error appears in the above-identified patent and that said Letters Patent is hereby corrected as shown below:

In column 7, line 24, in Claim 1, delete “longitudial” and insert -- longitudinal --, therefor.

Signed and Sealed this

Eighth Day of July, 2008

JON W. DUDAS
*Director of the United States Patent and Trademark Office*